US005997966A

United States Patent [19]

Sadur

[11] Patent Number: 5,997,966

[45] Date of Patent: Dec. 7, 1999

[54] DECORATIVE POMPON AND A METHOD FOR MANUFACTURING THE SAME

[76] Inventor: Dan Sadur, 123 Magnolia La., East Hills, N.Y. 11577

[21] Appl. No.: 09/006,429

[22] Filed: Jan. 13, 1998

Related U.S. Application Data

[60] Provisional application No. 60/041,160, Mar. 20, 1997.

[51] Int. Cl.[6] ..... D04D 7/06

[52] U.S. Cl. ..... 428/4; 28/147; 223/46

[58] Field of Search ..... 428/4; 223/46; 28/147; 63/3

[56] References Cited

U.S. PATENT DOCUMENTS

| | | | |
|---|---|---|---|
| 892,036 | 6/1908 | Emmert | 15/209.1 |
| 1,395,033 | 10/1921 | Bowers | 428/4 |
| 1,657,744 | 1/1928 | Durkee | 428/4 |
| 2,245,903 | 6/1941 | Cone | 28/147 |
| 2,810,977 | 10/1957 | Barry | 428/4 |
| 2,812,616 | 11/1957 | Ford | 428/4 X |
| 3,429,019 | 2/1969 | Linstead | 428/4 X |
| 3,509,580 | 5/1970 | Rubenstein et al. | 428/4 X |
| 4,476,167 | 10/1984 | Duftler | 428/4 |
| 4,976,056 | 12/1990 | Roberts | 428/4 X |
| 5,079,046 | 1/1992 | Kessler | 428/4 |

FOREIGN PATENT DOCUMENTS

| | | | |
|---|---|---|---|
| 589630 | 6/1947 | United Kingdom | 428/4 |

OTHER PUBLICATIONS

Page 659 of Webster's Seventh Collegiate Dictionary and the Title Page and Verso of the Title Page

*Primary Examiner*—Deborah Jones
*Assistant Examiner*—Stephen Stein

[57] ABSTRACT

A decorative pompon having a plurality of elongated elements of a predetermined length bound together with a retaining ring and extending generally radially outward therefrom. At least one of the elements is a tube that may be used to guide an anchor thread through the retaining ring so that the pompon may be easily secured to an article such as clothing, toys, luggage, packaging and jewelry.

20 Claims, 1 Drawing Sheet

FIG. 1
PRIOR ART
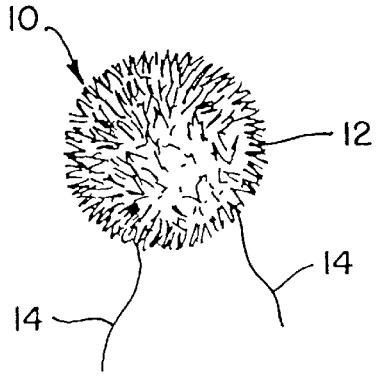
FIG. 3
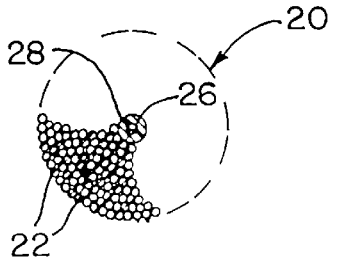
FIG. 2
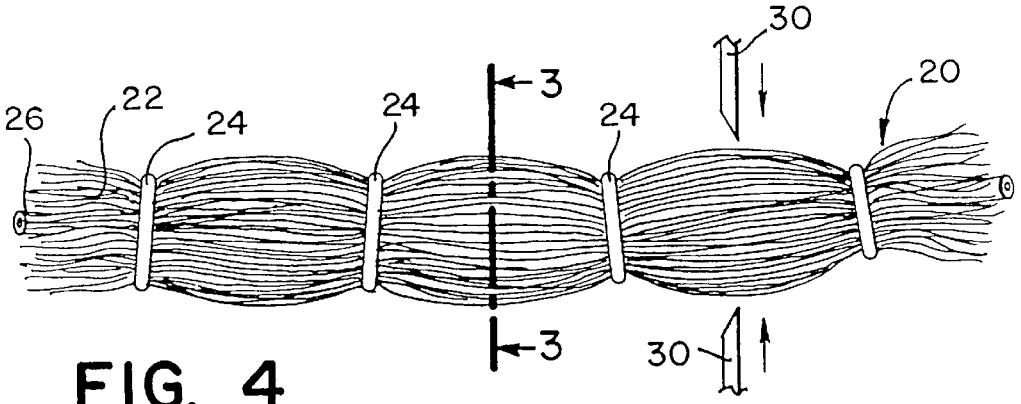
FIG. 4
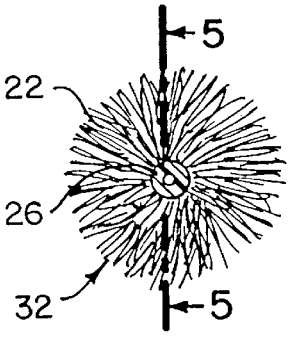
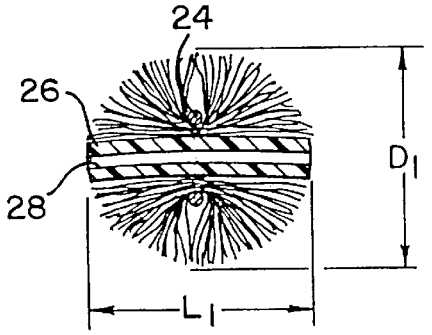
FIG. 5
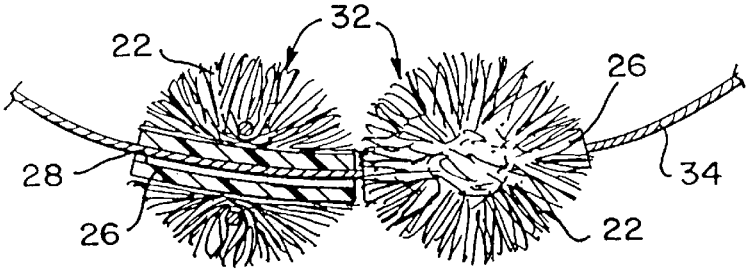
FIG. 6

DECORATIVE POMPON AND A METHOD FOR MANUFACTURING THE SAME

The present application claims the benefit of prior provisional application Serial No. 60/041,160 filed Mar. 20, 1997, in the name of Dan Sadur, entitled "DECORATIVE POMPOM AND A METHOD FOR MANUFACTURING SAME."

BACKGROUND OF THE INVENTION a) Field of the Invention

This invention relates to decorative elements, and more particularly, to decorative tufts or pompons that are typically attached to items of clothing as ornamentation or used as craft items.

b) Description of the Prior Art

It is well known that pompons consisting of cotton or other fibrous strands are widely used as ornaments on women's and children's clothing and other articles. These pompons consist of a multiplicity of strands, in the form of a bundle that is centrally held together tightly by a retaining ring. The retaining ring may be made from an elastomeric material, such as a rubber O-ring, or simple thread or cord that is looped around the fiber bundle, tightly drawn, and tied off. Regardless, the retaining ring exerts inwardly directed forces that force the bound fibers to flare radially outward evenly around the retaining ring, thus causing the fibers to form a generally spherical ball, or pompon.

Typically, pompons are secured to an article using either an adhesive or an anchor thread. If an adhesive is used, its application to the pompon will cause many of the soft cotton fibers to be encapsulated by the adhesive which will tend to flatten the secured half of the pompon. Use of an adhesive to secure a pompon to an article will prevent the pompon from freely dangling from the article, thus detracting from the usefulness of the pompon, since it is generally desirable to have the pompon dangle from the article.

The alternative use of an anchor thread to secure the pompon to an article may allow the pompon to dangle from the article once secured, however the anchor thread must pass through the retaining ring of the pompon to ensure a secure connection. Passing the anchor thread through the retaining ring of each pompon is generally a very difficult task.

An anchor thread may be formed integrally with each pompon, in which case, a few of the fibers are cut to a longer length than the bulk fibers. In doing so, an anchor thread will be created with the pompon which is secured by the retaining ring and may be used to secure the pompon to an article.

Creating an integral anchor thread with each pompon makes the otherwise relatively simple pompon manufacturing process more complex.

As described above, pompons are typically used to decorate an article of clothing. Each pompon is generally secured using its own anchor thread, as described above, or is individually glued to the clothing. An anchor thread may be used to string together two or more pompons along a single thread; however, in doing so, adjacent pompons have a tendency to interfere and flatten the fibers of neighboring pompons.

It is an object of the present invention to provide a decorative pompon that overcomes the deficiencies of the prior art.

It is another object of the invention to provide a decorative pompon that is easy and inexpensive to manufacture and attach to an article.

It is another object of the invention to provide a decorative pompon that may be easily threaded to an anchor thread without deforming or otherwise interfering with the fibers of the pompon.

SUMMARY OF THE INVENTION

The present invention provides a decorative pompon having a plurality of elongated elements of a predetermined length bound together with a retaining ring and extending radially outward therefrom. At least one of the elements is a tube that may be used to guide an anchor thread through the retaining ring so that the pompon may be easily secured to an article.

BRIEF DESCRIPTION OF THE DRAWINGS

FIG. 1 (labeled "Prior Art") is a perspective view of a prior art pompon, showing an integrally formed anchor thread;

FIG. 2 is a perspective view of a bundle of elongated elements of indefinite length including retaining rings located at predetermined intervals, in accordance with the present invention;

FIG. 3 is a sectional view of the bundle of elongated elements, taken along the line 3—3 of FIG. 2, showing the details of an integral tube, in accordance with the present invention;

FIG. 4 is a perspective view of a pompon, according to the present invention, showing one end of the tube;

FIG. 5 is a sectional view of the pompon, in accordance with the present invention, taken along the line 5—5 of FIG. 4, showing the details of the tube, elongated elements, and the retaining ring; and FIG. 6 is a partial sectional view of two pompons (one shown in section) secured together along a single anchor line, in accordance with the present invention.

DETAILED DESCRIPTION OF THE PREFERRED EMBODIMENT

Referring to FIG. 1, a prior art pompon 10 is shown having radially directed bulk fibers 12 and an anchor thread 14. Bulk fibers 12 have been secured by a retaining ring (not shown) and then cut to a desired length. The retaining ring is inwardly directed so that bulk fibers 12 spread radially outwardly, as shown. Anchor thread 14 is a bulk fiber that has been cut to a longer length so that it extends beyond the other fibers and may be used to attach the prior art pompon 10 to an article.

Referring to FIGS. 2 and 3, a bundle 20 of elongated elements 22 is shown having an indefinite length, according to the invention. Retaining rings 24 are tightly secured around elongated elements 22 at prescribed intervals depending on the size of pompon that is desired. For example, if a pompon having a diameter of 1 inch is desired, the retaining rings are positioned 1 inch apart. The retaining rings can be positioned at equal distances or different distances along the same bundle.

Included with elongated elements 22 and bound within each retaining ring 24, according to the invention, is a tube 26. Tube 26 is preferably made from a semi-rigid PVC plastic material, and includes a passage 28. Tube 26 may also be made from any semi-rigid material including other appropriate plastics, rubber, paper, or woven cloth. Tube 26 may also be made from a rigid material, such as a hard plastic, a rigid paper or cardboard, or a metal, however a semi-rigid material is preferred. It is important that tube 26 be made from a material that is sufficiently rigid to prevent passage 28 from crimping closed by the internally directed forces of retaining rings 24.

As is understood by those skilled in the art, after elongated elements 22 (including tube 26, according to the invention) are secured at predetermined intervals by retaining rings 22, bundle 20 is cut using a cutting mechanism 30 at predetermined intervals and between retaining rings 24 so that a pompon 32 is formed.

Referring to FIGS. 4 and 5, a pompon 32 according to the invention is shown having radially directed elongated elements 22 and tube 26, held tightly together by a retaining ring 24. Since tube 26 is preferably cut at the same time as elongated elements 22, tube 26 will have a length L1 that is generally the same as the length of each elongated element 22, and therefore, the same length as the diameter D1 of the pompon 32, as shown in FIG. 5.

In operation, a completed pompon 32, as shown in FIGS. 4 and 5, and according to the invention, may now be easily secured to an article (not shown) by simply passing an anchor thread 34 through passage 28 of tube 26. Since tube 26 is secured to elongated elements 22 by retaining ring 24, passage 28 passes through retaining ring 24 and anchor thread 34 will automatically be guided through retaining ring 24. With the pompon arrangement afforded by the present invention, anchor thread 34 may now quickly and easily be secured to each pompon and then secured to an article in a conventional manner.

If two or more pompons 32 are secured together along the same anchor thread 34, as shown in FIG. 6, the semi-rigid tubes 26 of each adjacent pompon 32 will abut each other and provide automatic or predetermined spacing for the pompons, thus preventing the typically soft and fibrous elongated elements 22 of each pompon 32 from entangling or otherwise interfering with each other. Tube 26 of each pompon 32 is effectively hidden from view by the surrounding tangle of radially extending elongated elements 22.

Elongated elements 22 are preferably made from a soft and fine acrylic yarn or fiber, however, any type of fiber may be used including natural fibers such as cotton, silk and wool, and synthetic fibers including rayon, polyester, latex, and polypropylene. Both elongated elements 22 and tube 26 may be colored, as desired and as readily understood by those skilled in the art.

Tube 26 is preferably centered within bundle 20, as shown in FIG. 3; however, tube 26 may be positioned in any radial position throughout bundle 20 (including along the outside periphery), without departing from the invention. Furthermore, although it is preferred that the length L1 of tube 26 be generally the same as the diameter D1 of pompon 32, tube 26 may be cut to any length (shorter or longer) depending on the particular application of the pompon. For example, tube 26 may be cut to be shorter than the diameter D1 of pompon 32 so that tube 26 does not hinder the soft feel and appearance of the pompon, even when sharply bent when secured to an article using an anchor thread 34 that is tightly looped. Tube 26 may be cut longer than diameter D1 of the pompon if, for example, several pompons 32 are to be strung together along an anchor thread 34 and it is desirable to space each pompon 32 (measured between centers of adjacent pompons 32) from each other a distance that is greater than the individual diameter D1.

As discussed above, apart from including a semi-rigid tube 26 within bundle 20, the manufacture of the pompons, according to the invention may be conventional, as described and known to those of ordinary skill in the art.

Pompons 32, according to the invention may be easily secured to many different articles including clothing such as socks, shirts, pants, swim-wear, hats and footwear, toys, including stuffed animals, luggage, packaging, gift wrapping, head bands, and jewelry. The present pompons 32 may also be used as craft items in which case they are easily threaded along a common anchor thread to form a bracelet or necklace, in which case, pompons 32 function as beads.

What is claimed is:

1. A pompon comprising:

an elongated tube having a passage;

a plurality of flexible elongated elements positioned around said tube;

a retaining ring positioned tightly around said tube and said elongated elements, said retaining ring providing an inwardly directed force crimping said elongated elements against said tube, said force causing said elongated elements to distort and extend generally radially outward from said retaining ring, said passage remaining substantially open through said retaining ring.

2. The pompon according to claim 1, wherein said elongated elements surround said elongated tube so that said retaining ring only contacts a portion of said elongated elements.

3. The pompon according to claim 1, wherein said retaining ring is made from metal wire.

4. The pompon according to claim 2, wherein said retaining ring is made from metal wire.

5. The pompon according to claim 2, wherein said retaining ring comprises a rubber material.

6. The pompon according to claim 1, wherein said retaining ring comprises a rubber material.

7. The pompon according to claim 1, wherein said retaining ring is made from string.

8. The pompon according to claim 2, wherein said retaining ring is made from string.

9. The pompon according to claim 1, further comprising a securing cord positioned within said passage of said elongated tube, said securing cord used to secure said pompon to a surface.

10. A decorative object to be suspended from a securing cord, said decorative object comprising:

an elongated tube having a passage;

a plurality of flexible elongated elements positioned around said tube;

a retaining ring positioned tightly around said tube and said elongated elements, said retaining ring providing an inwardly directed force crimping said elongated elements against said elongated tube, said force causing said elongated elements to distort and extend generally radially outward from said retaining ring to form a generally spherical object.

11. The decorative object according to claim 10, wherein said elongated elements surround said elongated tube so that said retaining ring only contacts a portion of said elongated elements.

12. The decorative object according to claim 10, wherein said retaining ring is made from metal wire.

13. The decorative object according to claim 11, wherein said retaining ring is made from metal wire.

14. The decorative object according to claim 10, wherein said retaining ring comprises a rubber material.

15. The decorative object according to claim 11, wherein said retaining ring comprises a rubber material.

16. The decorative object according to claim 10, wherein said retaining ring is made from string.

17. A necklace comprising:

a securing cord for securing a decorative object, said decorative object comprising:

an elongated tube having a passage, said passage being sized and shaped to receive said securing cord;

a plurality of flexible elongated elements positioned around said tube;

a retaining ring positioned tightly around said tube and said elongated elements, said retaining ring providing an inwardly directed force crimping said elongated elements against said elongated tube, said force causing said elongated elements to distort and extend generally radially outward from said retaining ring to form a generally spherical object.

18. The decorative object according to claim 10, wherein said tube passage remains open when said retaining ring is applied.

19. The pompon according to claim 1, wherein said elongated tube has a first length and each of said elongated elements has a second length, said first and second lengths being generally equal.

20. A method of making a pompon, comprising the steps of:

forming a bundle by arranging a plurality of elastic elongated elements including at least one elongated tube along an axis, said elongated tube being positioned in the general area of the middle of said bundle;

binding said bundle at predetermined points along said axis with a retaining ring, said ring applying a radially inwardly directed force so that said elongated elements press against said tube; and cutting said bundle at predetermined points located along said axis, said predetermined cutting points being located between said adjacent retaining rings.

* * * * *